US010513926B2

(12) United States Patent
Bergqvist

(10) Patent No.: US 10,513,926 B2
(45) Date of Patent: Dec. 24, 2019

(54) METHOD AND APPARATUS FOR ROCK REINFORCEMENT

(71) Applicant: EPIROC ROCK DRILLS AKTIEBOLAG, Örebro (SE)

(72) Inventor: Viktor Bergqvist, Örebro (SE)

(73) Assignee: EPIROC ROCK DRILLS AKTIEBOLAG, Örebro (SE)

( * ) Notice: Subject to any disclaimer, the term of this patent is extended or adjusted under 35 U.S.C. 154(b) by 0 days.

(21) Appl. No.: 16/091,593

(22) PCT Filed: Apr. 3, 2017

(86) PCT No.: PCT/SE2017/050330

§ 371 (c)(1),
(2) Date: Oct. 5, 2018

(87) PCT Pub. No.: WO2017/180042

PCT Pub. Date: Oct. 19, 2017

(65) Prior Publication Data

US 2019/0085692 A1 Mar. 21, 2019

(30) Foreign Application Priority Data

Apr. 12, 2016 (SE) ..... 1650492

(51) Int. Cl.
*E21D 20/02* (2006.01)
*E21D 21/00* (2006.01)

(52) U.S. Cl.
CPC ..... *E21D 20/028* (2013.01); *E21D 21/0053* (2016.01)

(58) Field of Classification Search
CPC . E21D 20/028; E21D 20/003; E21D 21/0053; E21B 21/10
See application file for complete search history.

(56) References Cited

U.S. PATENT DOCUMENTS 3,930,639 A * 1/1976 Steinberg ..... E21D 20/028 425/59
4,120,369 A 10/1978 Fischer et al.
(Continued)

FOREIGN PATENT DOCUMENTS

SE 506773 C2 2/1998
WO 2010031132 A1 3/2010
(Continued)

OTHER PUBLICATIONS

International Preliminary Report on Patentability dated Oct. 16, 2018 in corresponding international application No. PCT/SE2017/050330 (7 pages).
(Continued)

*Primary Examiner* — Carib A Oquendo
(74) *Attorney, Agent, or Firm* — Venable LLP; Jeffri A. Kaminski

(57) ABSTRACT

A method and an apparatus for rock reinforcement are described. The method comprises the steps: to inject a first component and a second component through a first channel and a second channel respectively into a rock hole, wherein the first component and the second component are adapted for rock reinforcement and to inject a blocking agent through a third channel into at least said second channel, wherein said blocking agent provides a barrier in at least said second channel.

15 Claims, 4 Drawing Sheets

(56) References Cited

U.S. PATENT DOCUMENTS

| | | | | |
|---|---|---|---|---|
| 4,974,689 | A * | 12/1990 | Issakainen | E21D 9/001 175/211 |
| 8,753,041 | B2 * | 6/2014 | Gray | E21B 21/10 405/259.1 |
| 9,175,561 | B2 * | 11/2015 | Brown | E21D 20/003 |
| 9,499,951 | B2 * | 11/2016 | Levey | E21D 20/02 |
| 2011/0070035 | A1 * | 3/2011 | Ricardo | E21D 20/02 405/259.5 |
| 2012/0020744 | A1 * | 1/2012 | Eigemann | E02D 5/80 405/259.5 |
| 2018/0066519 | A1 * | 3/2018 | Faulkner | E21D 20/028 |

FOREIGN PATENT DOCUMENTS

| | | | |
|---|---|---|---|
| WO | 2012171056 | A1 | 12/2012 |
| WO | 2014190382 | A1 | 12/2014 |

OTHER PUBLICATIONS

International Search Report and Written Opinion dated Jul. 3, 2017 in corresponding International Application No. PCT/SE2017/050330 (10 pages).

* cited by examiner

METHOD AND APPARATUS FOR ROCK REINFORCEMENT

CROSS-REFERENCE TO RELATED APPLICATIONS

This application is a U.S. National Stage application of PCT/SE2017/050330, filed Apr. 3, 2017 and published on Oct. 19, 2017 as WO 2017/180042, which claims the benefit of Swedish Patent Application No. 1650492-0, filed Apr. 12, 2016, all of which are hereby incorporated by reference in their entireties.

TECHNICAL FIELD

Present invention relates to mining industry. Particularly, the invention relates to a method and an apparatus at rock reinforcement, for example in conjunction with tunnelling.

BACKGROUND

In conjunction with tunnelling or in a mine, cracks in the rock layers often arise around a cavity in a mountain through which for example a future tunnel will run. The cracks weaken the rock in the mountain, which may result in that parts of the mountain may collapse. Therefore actions are needed that reduce the risk for collapse. The actions are usually called rock reinforcement. A common method for rock reinforcement is rock bolting. Rock bolting means that a bolt adapted for rock bolting is fastened in a drilled hole by a molding agent. In this way the rock layers are bonded-and held together so that the risk for collapse is reduced.

WO2012171056 describes an apparatus for injection of a resin in conjunction with rock bolting. The apparatus comprises an injector comprising a valve manifold with shuttle valves arranged in fluid inlets for injection of resin components. The valve manifold comprises also an additional inlet for a flushing fluid. All the tree inlets end in a common cavity that connects the inlets. The valves may be positioned in a position that permits injection of the components into a mixing chamber connected to the valve manifold. The valves may also be positioned in another position that permits supply of the flushing fluid through the additional inlet and the cavity for the purpose to flush the valve manifold and the mixing chamber. One disadvantage with the apparatus in WO2012171056 is that it may be rests of the resin components inside the inlets when the flushing fluid is injected in the valve manifold, which may impair reliability of service of the apparatus.

SUMMARY

An object of the invention is to improve the reliability of service at rock reinforcement. According to one aspect of the invention, the object is achieved by a method at rock reinforcement comprising the steps: to inject a first component and a second component through a first channel and a second channel respectively into a rock hole, wherein the first component and the second component are adapted for rock reinforcement and to inject a blocking agent through a third channel into at least said second channel, wherein said blocking agent provides a barrier in at least said second channel.

Because, the method comprises the step to inject the blocking agent through the third channel into at least the second channel, the blocking agent can extrude at least the second component from at least the second channel and can replace at least the second component inside at least the second channel where the blocking agent has been injected. In this way, an area in at least the second channel is achieved where at least the second component has been replaced by blocking agent. Further, because the blocking agent provides said barrier in at least the second channel, at least the second channel is blocked from coming in contact with for example moisture and/or the first component in at least the second channel where the blocking agent has been injected. In this way, the second component and for example moisture and/or the first component are held separated from each other in at least the second channel thanks to the blocking agent which constitutes said barrier. Thereby, at least the second channel is protected from for example coatings on at least the second channel, which coatings may be created when the second component cures upon contact with for example moisture and/or upon contact with the first component. As a result of thereof, the risk for a stop in at least second channel, i.e. the risk for that the second channel will be filled with coatings is reduced. Thereby, the risk for interruption during the work with rock reinforcement is decreased, i.e. reliability of a process of rock reinforcement is improved.

Consequently, a method at rock reinforcement is provided that achieves the above mentioned object.

According to some embodiments the method comprises the step: to provide, for example to drill, the rock hole before the step: to inject the first component and the second component through the first channel, respectively through the second channel into a rock hole is performed.

The method may comprise the step: to place a rock bolt adapted for rock reinforcement in the rock hole. This may permit that more efficient rock reinforcement is achieved than if rock reinforcement is performed without the rock bolt placed in the rock hole.

The first component and the second component may be injected through the rock bolt. In this way there is no need of removing the rock bolt from the rock hole. Thereby an efficient method at rock reinforcement is achieved because fewer steps are needed for injecting the first component and the second component into the rock hole, comparing to when removing of the rock bolt from the rock hole is needed for injection of the first component and the second component. Further advantageously, the first component and the second component may be guided into the rock hole through the rock bolt, i.e. along the interior of the rock bolt all the way into the rock hole. Thereby, an improved rock reinforcement is achieved because the first component and the second component may be sent all the way into the rock hole through the rock bolt.

The rock bolt may be a self-drilling bolt. Thereby, the rock bolt may be drilled into the rock hole and at the same time may be placed in the rock hole during the time for achieving the rock hole. This simplifies and makes the process of rock reinforcement more efficient because fewer steps are needed to achieve the rock hole and to place the rock bolt in the rock hole comparing to firstly drilling the rock hole, for example with a drill, and later to place a non-self-drilling rock bolt in the rock hole.

According to some embodiments the step: to inject a first component and a second component through a first channel and a second channel respectively into a rock hole, comprises injecting the first component and the second component at least partly simultaneously into the rock hole. Because the first component and the second component may be injected partly simultaneously into the rock hole, i.e. substantially at the same time, the first component and the second component may get into the rock hole substantially simultaneously and substantially without any time delay. This permits that the first component and the second component may be mixed with each other partly substantially during that the first component and the second component are injected into the rock hole. This may improve mixing of the first component and the second component. Thus, with advantage an improved method at rock reinforcement is obtained.

The method may also comprise the step: to inject a flushing agent into at least the first channel, wherein the blocking agent is adapted to prevent the flushing agent from coming into contact with the second component at the injection of the flushing agent.

Because the method may comprise the step to inject the flushing agent into at least the first channel, at least the first channel may be rinsed clean and possible remains of at least the first component may be carted away, i.e. removed from at least the first channel in an efficient manner. Further, because the blocking agent is adapted to prevent the flushing agent from coming into contact with the second component at the injection of the flushing agent, at least the second component may be prevented from coming into contact with the flushing agent in at least the second channel where the blocking agent has been injected. In this way, the second component and the flushing agent are held separated from each other in at least the second channel thanks to the blocking agent at injection of the flushing agent. Advantageously, crystallization of the second component in at least the second channel is prevented, which otherwise occurs when the flushing agent comes into contact with the second agent. Thereby, the risk that at least the second channel will be blocked, i.e. will be filled with crystals of the second component is decreased. As a result thereof the risk for interruptions during work with rock reinforcement is reduced, i.e. reliability at rock reinforcement is improved.

According to some embodiments the step: to inject the blocking agent through the third channel into at least the second channel is performed after the step to inject the first component and the second component through the first channel and the second channel respectively into a rock hole. As result of this, the blocking agent may extrude at least the second component and replace at least the second component in at least the second channel where the blocking agent has been injected. Thereby, a region in at least the second channel is obtained where at least the second component has been replaced by the blocking agent. Furthermore, or alternatively, according to the embodiments the step: to inject the flushing agent into at least the first channel is performed after the step: to inject the blocking agent through the third channel into at least the second channel. Thus, at least the first channel may be flushed by the flushing agent after that the first component and the second component have been injected into the rock hole. One advantage with this is that it may occur without risks that the flushing agent comes in contact with the other component in at least the second channel, which may cause a stop in the second channel. Thereby, with advantage an improved method at rock reinforcement is obtained that permits an effective cleaning of at least the first channel after injection of the first component and the second component into the rock hole. Further, the risk for a stop in at least second channel is decreased at flushing of at least the first channel. Thereby, the risk for interruption during the work with rock reinforcement is also decreased, which improves the reliability at rock reinforcement.

The first component may be a hardener and the second component may be a resin. In a known manner a mixture of the first component and the second component may be used to bond and to reinforce the rock.

According to a further aspect the object mentioned above is achieved by an apparatus at rock reinforcement comprising: a first channel adapted for injection of a first component into a rock hole and a second channel adapted for injection of a second component into the rock hole, wherein the first component and the second component are adapted for rock reinforcement. Further, the apparatus comprises a third channel for injection of a blocking agent into at least the second channel, wherein the third channel is directly connected to at least the second channel.

Because, the apparatus comprises the third channel for injection of the blocking agent into at least the second channel, the blocking agent can extrude at least the second component from at least the second channel and can replace at least the second component inside at least the second channel where the blocking agent has been injected. In this way, an area in at least the second channel is achieved where at least the second component has been replaced by the blocking agent and where at least the second component is blocked from coming in contact with for example moisture and/or the first component in at least the second channel where the blocking agent has been injected. In this way, the second component and for example moisture and/or the first component are held separated from each other in at least the second channel thanks to the blocking agent which constitutes said barrier. Thereby, at least the second channel is protected from for example coatings on at least the second channel, which coatings may be created when the second component cures upon contact with for example moisture and/or upon contact with the first component. As a result of thereof, the risk for a stop in at least second channel, i.e. the risk for that the second channel will be filled with coatings is reduced. Thereby, the risk for interruption during the work with rock reinforcement is decreased, i.e. reliability of a process of rock reinforcement is improved.

Further, because the third channel is directly connected to at least the second channel, the blocking agent may be injected directly to at least the second channel, i.e. without need of any detours. With advantage, an apparatus at rock reinforcement is achieved that permits an efficient injection of the blocking agent into at least the second channel.

Consequently, an apparatus at rock reinforcement is provided that improves the reliability during rock reinforcement and thereby the above mentioned object is obtained.

The first channel may be arranged to receive a flushing agent. Thereby, at least the first channel may be rinsed clean and possible remains of at least the first component may be carted away, i.e. may be removed from at least the first channel in an efficient manner by that the flushing agent can be sent through the first channel. Thereby, a compact apparatus at rock reinforcement is provided which permits flushing of at least the first channel.

According to some embodiments, the second channel comprises a valve-piston arranged to be positioned in at least a first position and a second position. In this way the valve-piston may change position between at least the first position and the second position. In the first position, the valve-piston may be arranged to permit injection of the second component into the rock hole, wherein in the second position the valve-piston may be arranged to prevent injection of the second component in the rock hole and to permit injection of the blocking agent into at least the second channel. Consequently, the second component may be sent into the rock hole in a simple way by that the valve-piston is positioned in the first position. Further, injection of the second component into the rock hole may be prevented in a simple way by that the valve-piston is positioned in the second position while injection of the blocking agent into at least the second channel may be permitted when the valve-piston is positioned in the second position. Thereby, an efficient apparatus at rock reinforcement is provided that in a simple and efficient way can control flow of the second component and of the blocking agent by a simple conversion of the valve-piston.

BRIEF DESCRIPTION OF THE DRAWINGS

The further aspects of the subject matter, including their particular features and advantages, will be readily understood from the following detailed description of one or several embodiments provided with reference to the accompanying drawings, where.

DETAILED DESCRIPTION

The embodiments herein will now be described in more detail with reference to the accompanying drawings, in which example embodiments are shown. Disclosed features of example embodiments may be combined. Like numbers refer to like elements throughout.

Figure 1:
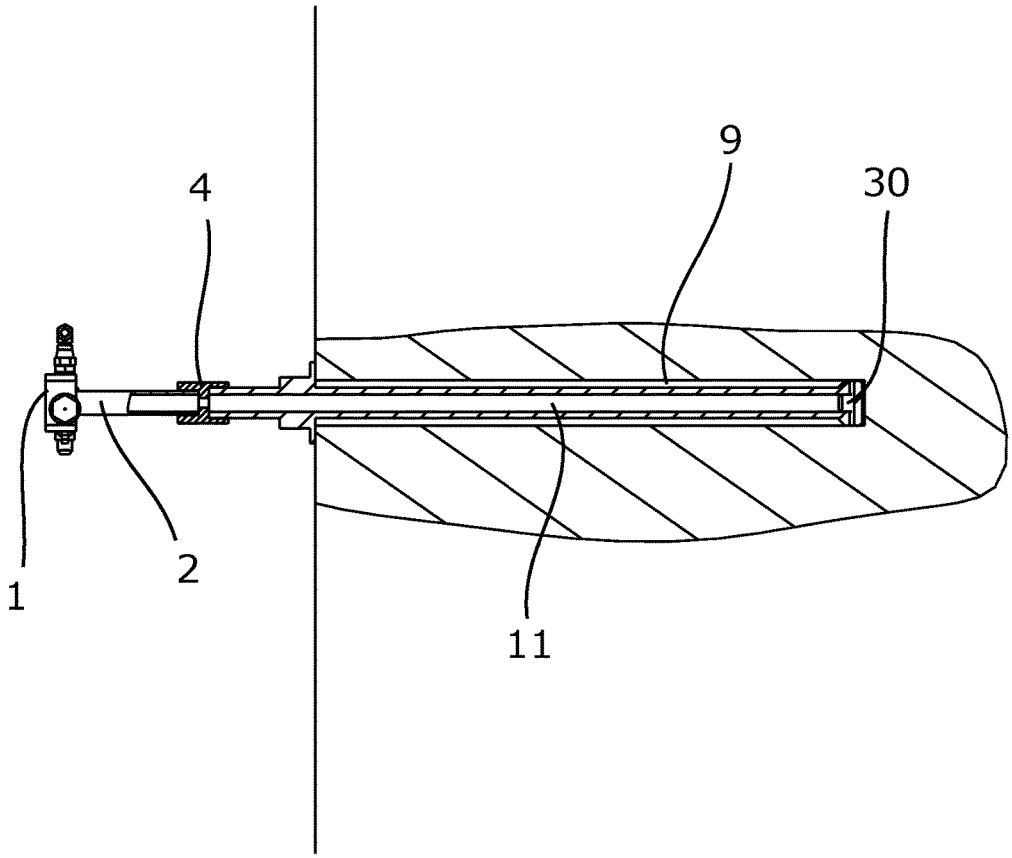
FIG. 1 is a side-view of an exemplified apparatus at rock reinforcement at a rock hole with a rock bolt, shown in cross-section.

FIG. 1 illustrates an exemplified embodiment of an apparatus 1 at rock reinforcement or sometimes called rock-bolting. The apparatus 1 has been connected to a rock bolt 11 through a mixer 2 and a connection means 4. FIG. 1 illustrates as well a cross section through a rock hole 9 in a mountain where the rock bolt 11 has been placed in the rock hole 9.

When a rock need to be reinforced, the rock hole 9 is drilled in the rock. This is made by using of a drill or by using a self-drilling bolt. The rock bolt 9 in FIG. 1 illustrates a self-drilling bolt comprising a drilling bit 30. A self-drilling bolt is placed in the rock hole while and simultaneously the rock hole is created by the self-drilling bolt. Self-drilling bolts are known in the art and therefor are not described herein in details.

To anchor the rock bolt 11 in the rock hole 9 and to achieve rock reinforcement, a molding agent as for example a mixture of components, is injected in the rock hole. The mixture of components is injected by the apparatus 1. The mixture of components is solidifying or hardening inside the rock hole and around the rock bolt 11 and in this way the rock bolt 11 is anchored or is fastened inside the rock hole. As a result of this the rock at and around the rock hole 9 is reinforced. According to the embodiment illustrated in FIG. 1, the rock bolt 11 is hollow, which permits the mixture of components may be injected through the rock bolt 11 and out through the drilling bit 30 into the rock hole 9.

Figure 2:
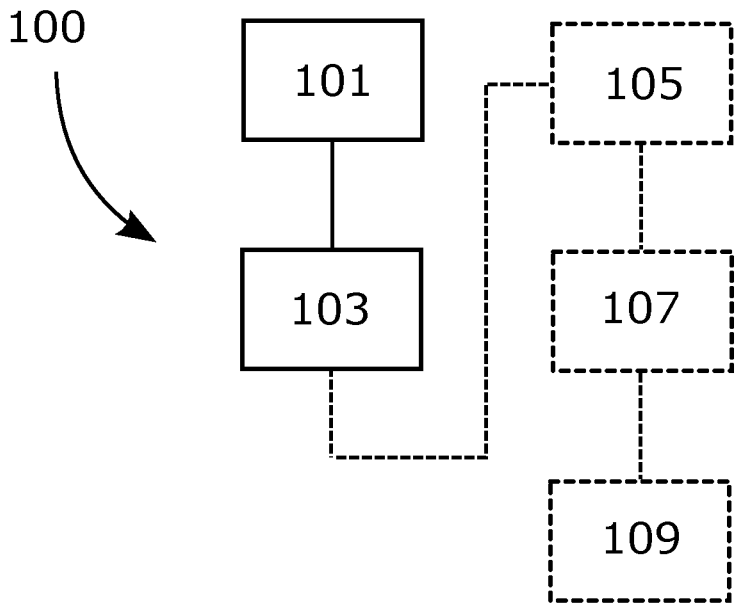
FIG. 2 is a flow-chart showing a method at rock reinforcement.

FIG. 2 shows an exemplified method 100 at rock reinforcement. The method 100 may for example be implemented by a control unit (not shown).

The method 100 comprises: to inject 101 a first component and a second component through a first channel and a second channel respectively into a rock hole, wherein the first component and the second component are adapted for rock reinforcement. The step to inject 101 the first component and the second component through the first channel and the second channel respectively into a rock hole may comprise to inject the first component and the second component at least partly simultaneously into the rock hole.

Further the method 100 comprises to inject 103 a blocking agent through a third channel into at least the second channel, wherein the blocking agent provides a barrier in at least the second channel.

The method 100 may also comprise to inject 103 a flushing agent into at least the first channel.

Further, the step to inject 103 the blocking agent through the third channel into at least the second channel may be performed after the step to inject 101 the first component and the second component through the first channel and the second channel respectively into a rock hole and/or wherein the step to inject 103 the flushing agent into at least the first channel may be performed after the step to inject 105 the blocking agent through the third channel into at least the second channel.

The method 100 may also comprise the step to inject the blocking agent into the first channel.

According to some embodiments, the method 100 may comprise to provide 107, for example to drill, the rock hole before the step to inject 101 the first component and the second component through the first channel and the second channel respectively into the rock hole is performed. The method 100 may further comprise to place 109 the rock bolt, adapted for rock reinforcement, in the rock hole.

Figure 3:
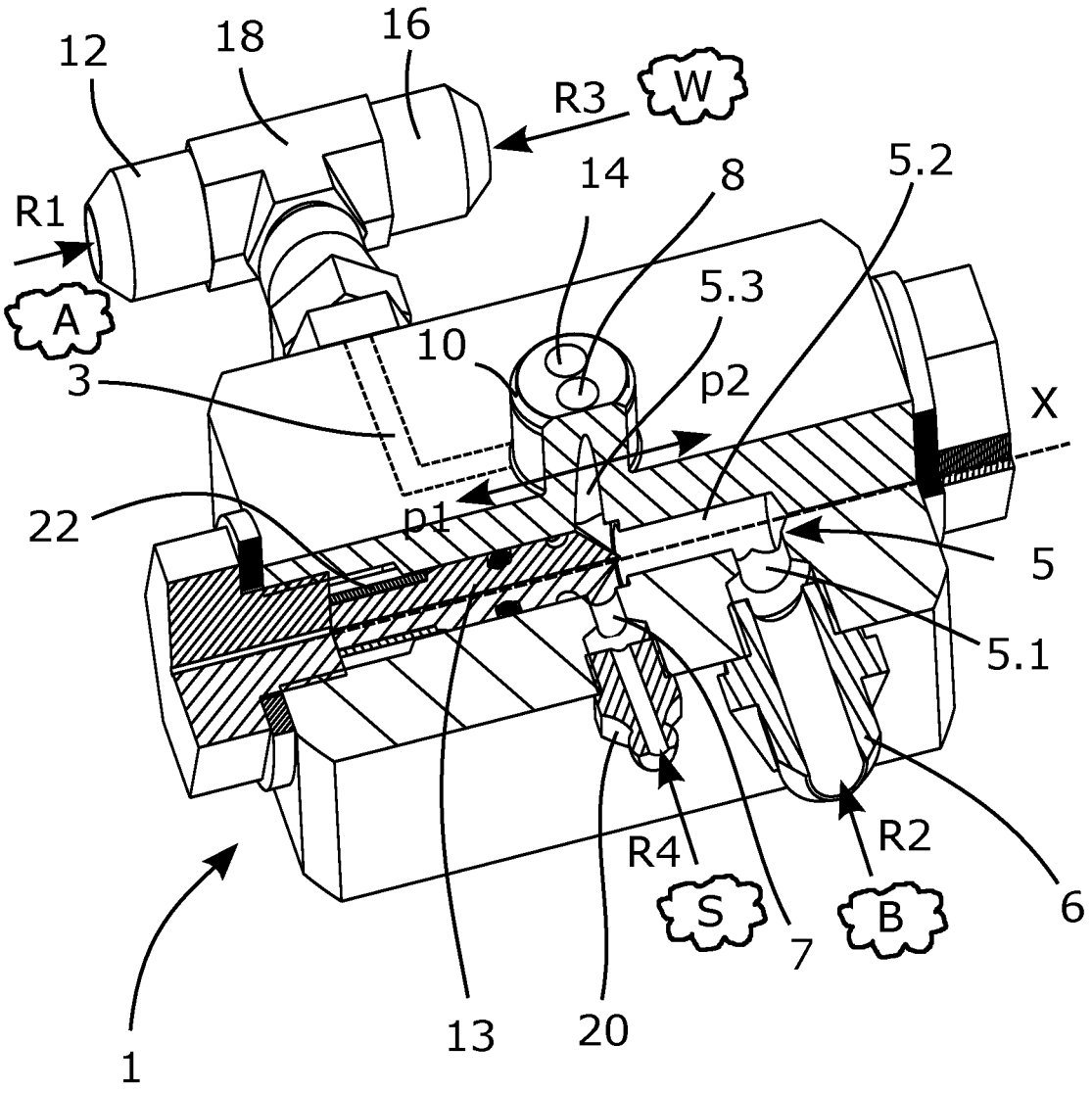
FIG. 3 is a perspective-view of the apparatus according to FIG. 1

FIG. 3 illustrates the apparatus 1 in FIG. 1. The apparatus 1 comprises a first channel 3 adapted for injection of first component A into a rock hole, and a second channel 5 adapted for injection of second component B into the rock hole. Thus, in this example, the earlier mentioned mixture of components comprises of the first and the second components A, B. According to the embodiment illustrated in FIG. 3, the second channel 5 comprises three sub-channels named a first sub-channel 5.1, a second sub-channel 5.2 and a third sub-channel 5.3. The first sub-channel 5.1 in FIG. 3 is arranged substantially radially, i.e. substantially perpendicular in relation to an axis X through the apparatus 1. The second sub-channel 5.2 is arranged substantially along the axis X and substantially in the middle of the apparatus 1. The third sub-channel 5.3 extends along a direction substantially perpendicular in relation to the axis X and substantially perpendicular in relation to the first sub-channel 5.1. The first sub-channel 5.1 extends also from a second channel nozzle 6 arranged at a periphery of the apparatus 1 towards the second sub-channel 5.2 arranged substantially in the middle of the apparatus 1 and the third sub-channel 5.3 extends from the second sub-channel 5.2 and ends through a second opening 8 of an outlet nozzle 10.

The directions "towards" and "from" refer here directions in relation to injection direction R2 of the second component B at the inlet to the second channel nozzle 6 and in relation to the axis X. The second channel nozzle 6 is arranged to receive a second hose (not shown) for supplying of the second component B into the apparatus 1. The tree sub-channels 5.1, 5.2 and 5.3 are interconnected with each other and together form the second channel 5.

The first channel 3 (not shown in details in FIG. 3) may be arranged in a similar manner as the second channel 5. Thereby, the first component A may be injected, for example in the injection direction R1 of the first component A, through a first channel nozzle 12 into the apparatus 1 and further out through a first opening 14 of the outlet nozzle 10.

The first channel nozzle 12 is arranged to receive a first hose (not shown) for supplying of the first component A to the apparatus 1. In the similar way as the second component B above refer directions "in" and "out" directions in relation to the injection direction R1 of the first component A at the inlet to the first channel nozzle 12.

The first channel 3 and the second channel 5 are separated from each other that the first component A and the second component B do not come in contact with each other inside the apparatus 1. The first channel 3 and the second channel 5 may be achieved by for example molding of the apparatus 1 in a form. The form is then designed so that two separate channels are obtained inside the apparatus 1 after a molding process. The first channel 3 and the second channel 5 may also be achieved by processing as for example drilling, milling or similar.

The outlet nozzle 10 may be arranged to receive a mixer (not shown in FIG. 3) adapted to mix the first component A and the second component B with each other.

The first component A and the second component B are adapted for rock reinforcement, i.e. they are developed for example this purpose. The first component A may contain a hardener as for example sodium silicate, an alcohol, a polyol or similar or a combination thereof. The second component B may contain a resin as for example methylene diphenyl isocyanate (MDI) or similar. The first component A and the second component B are intended to be mixed with each other at injection of the first component and the second component A, B into the rock hole. Mixing of the first component A and the second component B may preferably be done in a mixer (not shown). The mixer may then be connected to the outlet nozzle 10. When the components A, B are mixed a reaction in the resin starts that is trigged by the hardener and that results in that crosslinks in the resin are created. Said mixture of the first component A and the second component B may be guided, or brought, further from the mixer into the rock hole where the mixture is and thereby a rock bolt is anchored inside the rock hole to reinforce the rock around the rock hole.

As illustrated in FIG. 3, the first channel 3 may be arranged to receive a flushing agent W, for example in a direction R3 of the flushing agent. This, through a flushing nozzle 16. According to the embodiment illustrated in FIG. 3, the first channel nozzle 12 and the flushing nozzle 16 are arranged at a T-connection 18 connected to the first channel 3. The flushing nozzle 16 is arranged to receive a flushing hose (not shown) for supplying of the flushing agent W into the apparatus 1. The T-connection 18 comprises a valve (not shown) for controlling the flows of the first component A and of the flushing agent W into the first channel 3. The valve is arranged so that when injecting the first component A inflow of the flushing agent W into the first channel 3 is prevented and is arranged so that when injecting of the flushing agent W the inflow of the first component A into the first channel 3 is prevented.

The flushing agent W may be water, oil or similar.

The apparatus 1 comprises also a third channel 7 for injecting of a blocking agent S into at least the second channel 5. According to the embodiment illustrated in FIG. 3, the third channel 7 is arranged substantially parallel with the second channel 5 and is direct connected to the second sub-channel 5.2 of the second channel 5. The third channel 7 is connected to a third channel nozzle 20, which third channel nozzle 20 is adapted to receive a third hose (not shown) for supplying, for example in an blocking agent S injection direction R4, of the blocking agent S into the apparatus 1.

The apparatus 1 may comprise a fourth channel (not shown) for injecting of the blocking agent S into the first channel 3. The fourth channel may be arranged in a similar way as the third channel 7 described above.

The blocking agent S is an agent with chemical characteristics that make that the blocking agent S does not mix with any of the first component A, the second component B or with the flushing agent W. Further, the blocking agent may have protecting characteristics against wear inside the apparatus 1. The blocking agent S may be fat and viscous agent as for example fat, silicone or similar.

According to the embodiment illustrated in FIG. 3, the second channel 5 comprises a valve-piston 13 movable arranged in the second channel 5 so that the valve-piston 13 may be positioned in a first position p1 and a second position p2. The valve piston 13 may form a part of a needle valve. Thus, the needle valve comprises the valve-piston 13, for example in a form of a needle, piston or similar. The needle valve may be biased in the second position by a spring 22 in a known manner. Also other types of valves than needle valve may be used in the apparatus 1. For example, a ball valve, cone valve or similar may be used. The needle valve or if other type of valve, may be controlled hydraulically or electrically.

The valve-piston 13 in FIG. 3 is illustrated in the first position p1. In the first position p1, the valve-piston 13 is arranged to permit injection of the second component B into the rock hole. When the second component B is pumped into the apparatus 1 through the second channel nozzle 6 and by a pump (not shown) a pressure in the second channel is created that cause the valve-piston 13 to move to the first position p1. The spring 22 is adapted to act on the valve-piston 13 with a spring force that is less than a pressure force acting on the valve-piston 13 by the pressure in the second channel 5 caused by the second component B when the second component B is injected into the second channel 5. As illustrated in FIG. 3, in the first position of the valve-piston 13, the inlet to the third sub-channel 5.3 is open so that the second component B may flow into the third sub-channel 5.3 and further out through the second opening 8.

According to the embodiment illustrated in FIG. 3, the valve-piston 13 is arranged to permit injection of the blocking agent S into the second channel 5 when the valve-piston 13 is in the first position p1. However, a control unit (not shown) is connected to the apparatus 1 and is arranged to stop supply of the blocking agent S into the second channel 5 in the first position p1 of the valve-piston 13.

Figure 4:
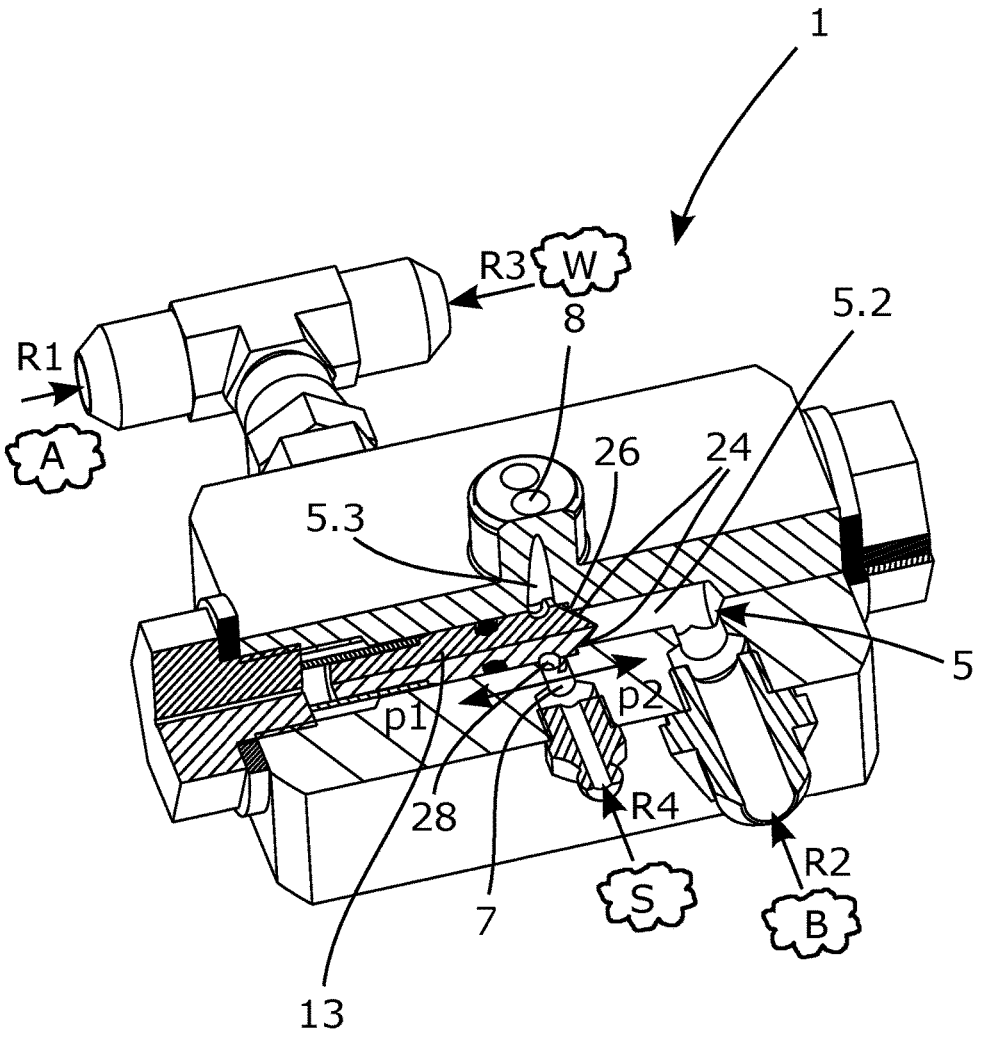
FIG. 4 is another perspective-view of the apparatus according to FIG. 1 and FIG. 3.

FIG. 4 illustrates the apparatus 1 in FIG. 3. In FIG. 4, the valve-piston 13 is shown in the second position p2. In the second position p2, the valve-piston 13 is arranged to prevent injection of the second component B into the rock hole and to permit injection of the blocking agent S into at least the second channel 5. When earlier mentioned pump (not shown) for pumping of the second component B stops to work, the pressure in the second channel 5 decreases. This permits that the spring force of the spring 22 can overcome the inertia of the second component B in the second channel 5 and to move the valve-piston 13 to the second position p2. As illustrated in FIG. 4, the valve-piston 13 has been moved to the second position p2 by the spring 22, thereby has revert to its biased position. The valve-piston 13 comprises a surface 24 adapted to join tight in contact with an edge surface 26 of the second sub-channel 5.2 at the inlet to the third sub-channel 5.3 and at the transition area between the second sub-channel 5.2 and the third sub-channel 5.3 in the second position p2 of the valve-piston 13. In the second position p2 the spring 22 may act on the valve-piston 13 with a spring force that permits a tight connection between the surface 24 and the edge surface 26. Thereby, the inlet to the third sun-channel 5.3 may be blocked for the second component B in the second position p2 of the valve-piston 13, which may prevent injection of the second component B into the third sub-channel 5.3.

When the valve-piston 13 is in the second position p2, injection of the blocking agent S into at least the second channel 5 is permitted. As illustrated in FIG. 4, the valve-piston 13 may comprise a channel 28 arranged around the valve-piston 13, for example in its surface along a cross section of the valve-piston 13. In the second position p2, the channel 28 is arranged to create a connection channel between the third channel 7 and the third sub-channel 5.3 of the second channel 5. Thereby, injection of the blocking agent S into the third sub-channel 5.3 is permitted. When the blocking agent S is injected into the third sub-channel 5.3, the second component B is extruded from the third sub-channel 5.3 through the second opening 8. Thereby, the sub-channel 5.3 is filled with the blocking agent S, which protects the sub-channel 5.3 from other substances to flow into the sub-channel 5.3.

The third channel 7 may be arranged so that the third channel 7 is connected directly to the third sub-channel 5.3. According to such embodiment, the valve 13 may be arranged without a channel.

As described, above the apparatus 1 may comprise the fourth channel (not shown) for injecting of the blocking agent S into the first channel. The fourth channel may be connected to the first channel in similar way arranged in a similar way as the third channel 7 is connected to the second channel 5 as above.

Thus, in the second position p2, the flushing agent W may be injected into the rock hole without risks that the flushing agent W comes in contact with the second component B inside the second channel 5 of the apparatus 1. Consequently, with advantage crystallization of the second component B in at least the second channel 5 is prevented, which otherwise occurs when the flushing agent S comes in contact with the second component B. Thereby, the risk that at least the second channel will be blocked, i.e. will be filled with crystals of the second component is decreased. As a result thereof the risk for interruptions during work with rock reinforcement is reduced, i.e. reliability at rock reinforcement is improved.

The invention claimed is:

1. Method at rock reinforcement comprising the steps:

a) to inject a first component and a second component through a first channel and a second channel respectively into a rock hole wherein the first component and the second component are adapted for rock reinforcement, characterized in that method comprises the step:

b) to inject a blocking agent through a third channel into at least said second channel, wherein said blocking agent provides a barrier in at least said second channel.

2. Method according to claim 1, wherein the method comprises the step: c) to provide said rock hole before said step a) is performed.

3. Method according to claim 1, wherein the method comprises the step: d) to place a rock bolt adapted for rock reinforcement in said rock hole.

4. Method according to claim 3, wherein said first component and said second component are injected through said rock bolt.

5. Method according to claim 3, wherein said rock bolt is a self-drilling bolt.

6. Method according to claim 1, wherein said step a) comprises injecting said first component and said the second component at least partly simultaneously into said rock hole.

7. Method according to claim 1, wherein the method comprises the step:

e) to inject a flushing agent into at least said first channel, wherein said blocking agent is adapted to prevent said flushing agent from coming into contact with said second component at said injection of said flushing agent.

8. Method according to claim 7, wherein said step b) is performed after said step a) and/or wherein said step e) is performed after said step b).

9. Method according to claim 1, wherein said first component is a hardener and said second component is a resin.

10. Apparatus for rock reinforcement comprising:

a first channel adapted for injection of first component into a rock hole, a second channel adapted for injection of second component into said rock hole, wherein said first component and said second component are adapted for rock reinforcement and a mixer in connection with the first channel and the second channel for mixing the first component and the second component before the mixture is injected into the rock hole, a third channel directly connected to the second channel for injection of a blocking agent into at least said second channel, wherein when injected into at least said second channel the blocking agent provides a barrier in at least said second channel, wherein said third channel is also in connection with the mixer through said second channel.

11. Apparatus according to claim 10, wherein the third channel contains said blocking agent.

12. Apparatus according to claim 10 wherein the apparatus comprises a fourth channel for injecting of the blocking agent into the first channel, wherein said blocking agent provides a barrier in at least said first channel.

13. Apparatus according to claim 10 wherein the third channel is connected to a third channel nozzle, which third channel nozzle is adapted to receive a third hose for supplying of the blocking agent into the apparatus.

14. Apparatus according to claim 10 wherein at least said second channel comprises a valve-piston arranged to be positioned in at least a first position and a second position, wherein said valve-piston, in said first position, is arranged to permit injection of said second component into said rock hole, and wherein said valve-piston, in said second position, is arranged to prevent injection of said second component into said rock hole and to permit injection of said blocking agent into at least said second channel, wherein said valve-piston comprises a slot arranged so that, in said second position of the valve-piston, injection of said blocking agent is permitted into a third sub-channel of said second channel, and wherein, in said second position of the valve-piston, an inlet of the third sub-channel is blocked for the second component, preventing injection of the second component into the third sub-channel.

15. Apparatus according to claim 10, wherein said first channel is arranged to receive a flushing agent.

* * * * *